US006367121B1

(12) United States Patent
MacMillan

(10) Patent No.: US 6,367,121 B1
(45) Date of Patent: Apr. 9, 2002

(54) ADJUSTABLE LENGTH HANDLE FOR FLAT FINISHERS

(76) Inventor: Donald M. MacMillan, P. O. Box 223 151-10090 152 NO St., Surrey, B.C. (CA), V3R 8X8

( * ) Notice: Subject to any disclaimer, the term of this patent is extended or adjusted under 35 U.S.C. 154(b) by 0 days.

(21) Appl. No.: 09/595,965

(22) Filed: Jun. 19, 2000

(51) Int. Cl.[7] ..... B25G 3/00; A45C 13/22

(52) U.S. Cl. ..... 16/110.1; 16/429; 16/436; 16/900; 15/235.8

(58) Field of Search ..... 16/110.1, 429, 16/436, 113.1, 405, 900; 15/235.8, 144.1, 144.2, 144.3, 143.1; 403/83, 84, 85, 102, 103, 104, 108, 109, 110; 294/19.1

(56) References Cited

U.S. PATENT DOCUMENTS 3,090,984 A * 5/1963 Dunnigan ..... 294/19.1
3,105,262 A * 10/1963 Lathrop et al. ..... 15/235.7
4,592,797 A * 6/1986 Carlson ..... 15/235.4
5,088,147 A * 2/1992 MacMillan ..... 15/235.4
5,099,539 A * 3/1992 Forester ..... 16/429

* cited by examiner

*Primary Examiner*—Chuck Y. Mah
(74) *Attorney, Agent, or Firm*—Robert W. Jenny

(57) ABSTRACT

The primary structural parts of the handle are two telescopic tubes, the smaller diameter tube being an extrusion. A rib on the smaller tube engages a notch in a fitting attached to the larger tube to prevent relative rotation of the tubes. A box footplate is pivotally attached to the free end of the larger tube, the axis of the pivot being perpendicular to the axis of the tubes. The footplate is connected by a connecting link to the end of a tube which slides longitudinally in the handle and fits through a clamp mechanism installed in the overlapped end of the smaller tube and is operated by a clamp mechanism operating assembly attached to the free end of the smaller tube. Operating a lever of that assembly engages the tube in the lock mechanism, preventing it from moving longitudinally and the footplate from pivoting on the handle. The length of the handle is manually adjustable and is set at a desired length by a lever operated lock assembly attached to the overlapped end of the larger tube.

2 Claims, 2 Drawing Sheets

ADJUSTABLE LENGTH HANDLE FOR FLAT FINISHERS

BACKGROUND OF THE INVENTION

1. Field

The subject invention is in the field of extendable/retractable apparatus such as tent poles, fishing rods and boat hooks which can be set at any length within a length range. More specifically it is in the field of such apparatus which incorporates mechanism by which one mechanism at one end of the apparatus operates and controls another mechanism at the other end of the apparatus. Still more specifically it is in the field of such apparatus and related mechanisms adapted for use with apparatus used in construction of dry walls in buildings, apparatus known in the trade as a flat finishing box, used in the crowning and finishing of taped joints between drywall panels.

2. Prior Art

Known prior art is shown in the patents listed below. These patents are:

| | |
|---|---|
| 2,934,937 | 4,592,797 |
| 3,105,262 | 5,088,147 |
| 3,146,481 | 5,099,539 |
| 3,090,984 | |

In the field of drywall construction and finishing, apparatus termed a flat finishing box is attached to a handle to enable the operator to apply the box to the joints being serviced by the box. To adapt the apparatus to various use situations various lengths of handles are needed to work with, for example, a variety of heights of ceilings and, also, the box must be set in a range of angles with respect to the long axis of the handle. The conventional apparatus comprises a fixed length handle with a lever at one end operable to lock the box pivoted at the other end of the handle at a specific angle in a range of angles to the handle axis. When a variety of lengths of handles is required, it is necessary either to have a number of flat finishing boxes, each attached to a specific length handle or to use fewer boxes than handle lengths required, (usually one box) and interchange the box or boxes from handle to handle in order to have the box on a handle of suitable length. The use of multiple boxes, each with a different length handle attached, is not generally acceptable because of the cost and because the compound used in the boxes sets up, i.e. hardens, so that compound in boxes not fully emptied in use is wasted and removal of the wasted compound is time consuming. The use of fewer boxes than handles is standard practice but changing the boxes from handle to handle is time consuming and tends to be awkward if the box contains the compound referred to in the trade as "mud".

Therefore, for flat finishing drywall joints more efficiently in terms of the interrelated factors of time and cost, there has been a need for a flat finishing tool with an adjustable length handle, particularly one adjustable to specific lengths in a range of lengths.

U.S. Pat. No. 5,099,539 (Forrester), U.S. Pat. No. 5,088,147 (MacMillan, the inventor of the subject invention) U.S. patent application, Ser. No. 09/414,677 by MacMillan and U.S. patent application, Ser. No. 09/502,896, also by MacMillan all show adjustable length handles for flat finishers. All of these handles have a lever pivoted at one end and a part called a box footplate pivoted at the other. In use a flat finishing box is attached to the footplate, the handle is adjusted to the needed length and the handle is maneuvered to place the box against the work surface. This placement sets the box and box footplate at an angle to the long axis of the handle and the lever is operated to lock the box and box footplate at that angle relative to the handle. The mechanical complexity of these prior art adjustable length handles for flat finishers is typical in the prior art and increases first and maintenance costs of the handles and degrades their reliability, thereby increasing operation costs. The lock mechanism in particular tends to be delicate relative to its performance requirements and the range of angular motion of the box footplate is quite limited. The handle of U.S. patent application, Ser. No. 09/414,677 is considered to be the least complicated and most rugged of the three prior art handles. Nevertheless, there is a continued need for more ruggedness and simplicity, to reduce first, use and maintenance costs.

Accordingly, the primary objective of the subject invention is to provide a less complicated adjustable length handle for flat finishers because of the significant savings in costs that the reduced complication facilitates. Other objectives are that the range of angular motion of the box footplate be relatively large, that there be no highly loaded small parts, that the handle be relatively lightweight and that it be ergonomically acceptable.

SUMMARY OF THE INVENTION

The subject invention is an adjustable length handle for flat finishers. The primary structural components of the handle are two telescopic tubes. Relative rotation of the engaged tubes is prevented by engagement of a longitudinal rib on the outside of one tube with a groove in a fitting on the other tube. When the tubes are telescopically engaged each has an overlapped end and a free end. A fitting termed a box footplate is pivotally attached to a second fitting attached to the free end of the larger, outer tube, with a pivot axis perpendicular to the long axis of the tubes. The rotation of the footplate with respect to the long axis of the tubes is controlled by a connecting link which connects the footplate to a tube which is slidably mounted in the handle with its axis parallel to the axis of the handle. A lever pivoted at the free end of the smaller tube is linked to a clamp mechanism anchored in the overlapped end of the smaller tube. The tube linked to the footplate extends through and is supported by the clamp mechanism. Operations of the level clamps the linked tube, preventing it from linear motion and thus preventing rotation of the footplate relative to the handle.

The clamp mechanism comprises three parts: a base, a clamp and a clamp actuator. The base is attached inside the overlapped end of the smaller tube. The clamp is installed in the base and fastened in it so that it cannot move endwise. There is a hole endwise through the clamp for tube which is linked to the footplate and a slit from the hole to the upper face of the clamp. Pressure to narrow the slit clamps the tube. Pressure is applied by longitudinal motion of the clamp actuator. A cam follower roller on the clamp engages a slanted slot in the actuator so that longitudinal motion of the actuator causes lateral motion of the cam follower and the portion of the clamp it's attached to.

The invention is described in more detail below with reference to the attached drawings.

DETAILED DESCRIPTION OF THE INVENTION

Figure 1:
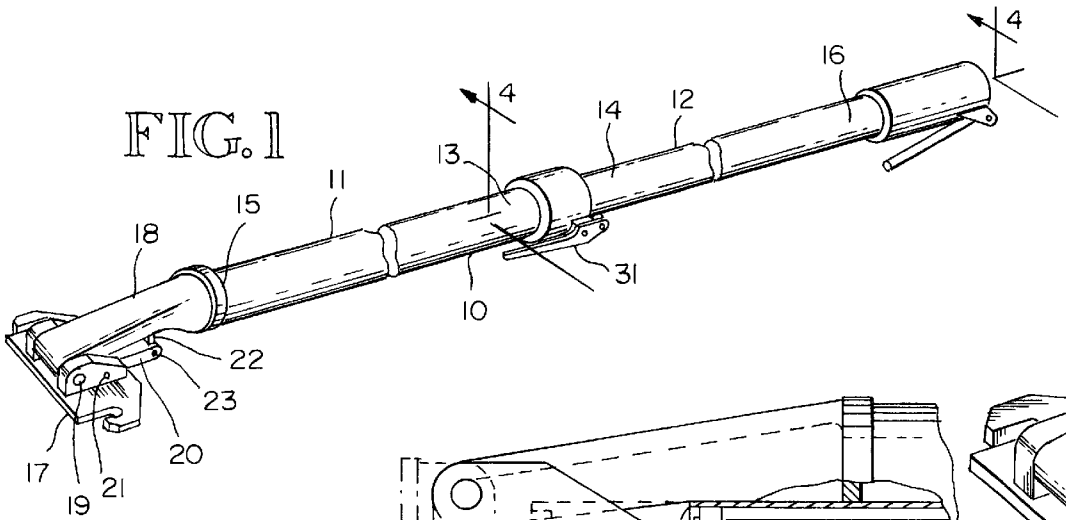
FIG. 1 is a general view of the subject handle.

The subject invention is an adjustable length handler for flat finishers, one embodiment of the invention being shown in FIG. 1. Handle 10 comprises two telescopic tubes 11 and 12 having a common longitudinal axis. Tube 12 is an extrusion, described in more detail below and telescopes into tube 11. Tube 11 is termed the larger tube and tube 12 the smaller tube. The ends of the tubes which telescope are termed the overlapped ends, end 13 of tube 11 and end 14 of tube 12. The other ends of the tubes are termed free ends, end 15 of tube 11 and 16 of tube 12. In use a flat finisher (not shown) is attached to box footplate 17. The footplate is pivotally connected to footplate fitting 18 by shaft 19. Rotation of the footplate is restricted by link 20, pivotally connected to the footplate by pin 21 and to fitting 22 by pin 23. Fitting 22 is attached to end 24 (FIG. 2) of lock tube 25. The longitudinal axis of a longitudinally sliding member, lock tube 25, is parallel to the longitudinal axis of the handle tubes. Tube 25 is supported by and slides in hole 26 in fitting 18 (FIG. 2) and a clamp mechanism described below. In use the flat finisher attached to the footplate is placed against a work surface, setting the footplate at a use angle to the handle. The footplate is then locked at that angle by operation of the clamp mechanism by the clamp mechanism operating assembly 26A, using lever 27 pivoted by pin 28 to operating assembly fitting 29 attached to end 16 of tube 12. Handle length lock mechanism 30 is attached to end 13 of tube 11. Lifting lever 31 releases the lock so that the length of the handle can be adjusted. Releasing the lever allows the lock to reset, fixing the length of the handle. The lock mechanism is described in detail below.

Figure 2:
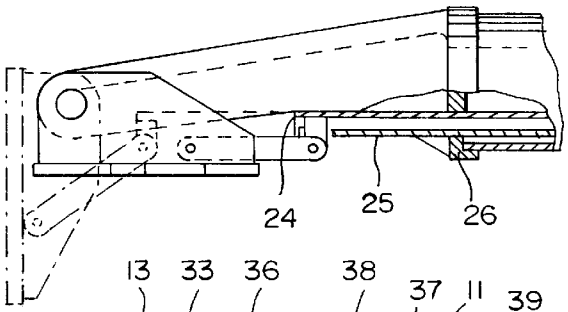
FIG. 2 is an enlarged view of the box footplate pivoted to a footplate fitting attached to the free end of the outer tube of the handle.

FIG. 2 illustrates that there is at least 900 of freedom of the footplate on the handle. The footplate is shown in solid lines at one extreme of its motion and in phantom lines at the other extreme.

Figure 3:
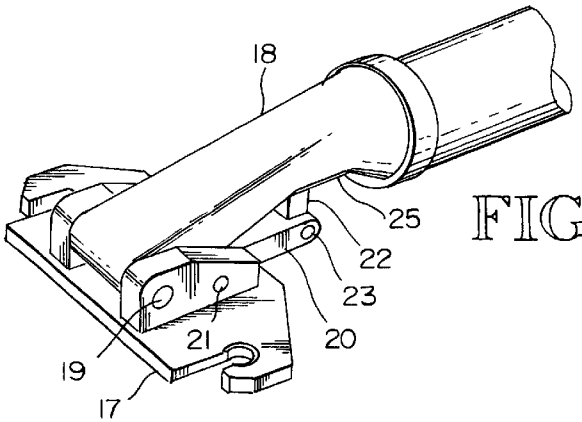
FIG. 3 illustrates the range of angular movement of the footplate.

FIG. 3 is an enlarged view of the footplate, the fitting to which it is pivoted, the link, the tube end fitting, and the control tube, numbered as in FIGS. 1 and 2.

Figure 4:
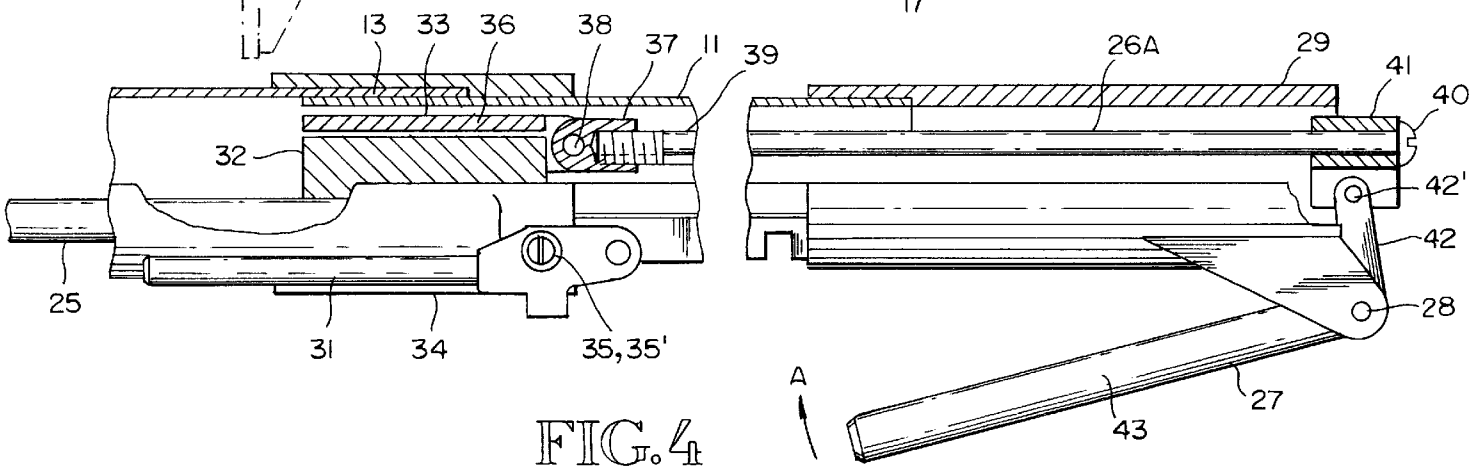
FIG. 4 is a sectioned and cutaway view of the handle taken at 4—4 in FIG. 1.

FIG. 4 is a sectional view taken at 4—4 in FIG. 1. Tube 25 is shown extending through clamp 32 of the clamp mechanism 33 in end 14 of tube 12. Fitting 34 of the lock mechanism is attached to end 13 of tube 11 and lever 31 is pivoted to it by screws 35 and 35'. Cam 36 of the clamp mechanism is pivotally connected to fitting 37 by pin 38. Rod 39 is screwed into fitting 37 and is supported at its head end 40 in rod fitting 41. Fitting 41 is pivotally connected to arm 42 of lever 27 by pin 42'. Moving handle 43 of lever 27 in the direction shown by arrow A applies a pulling force on rod 39, moving cam 36 to operate the clamp and prevent longitudinal motion of tube 25 and rotation of the footplate. The clamp operating assembly 26A comprises fitting 29, fitting 37, pin 38, and rod 39, fitting 41, and lever 27.

Figure 5:
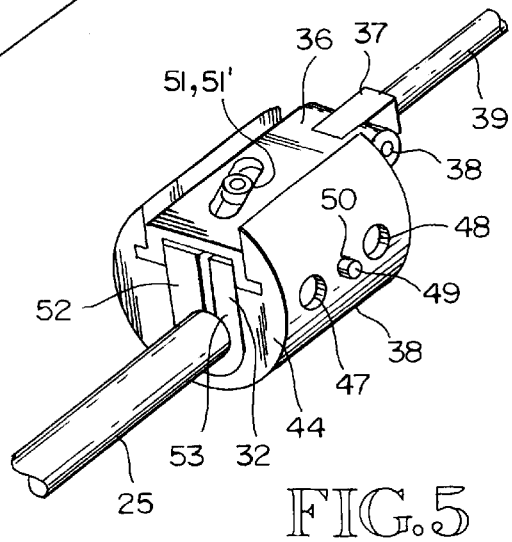
FIG. 5 illustrates the clamp mechanism.

FIG. 5 illustrates the clamp mechanism. Clamp 32 is installed in base 44 and held in place by fastener in holes 45 and 46 (FIG. 6) in the clamp and holes 47 and 48 in the base. The mechanism is restrained longitudinally in tube 12 by pin 49 which is a press fit in hole 50 and extends through the wall of tube 12 and is flush with the outer surface of the tube. Cam slot 51 in cam 36 engages roller follower 51' attached to side 52 of the clamp. Pulling on rod 39 forces side 52 of the clamp toward side 53, locking tube 25 in place longitudinally.

Figure 6:
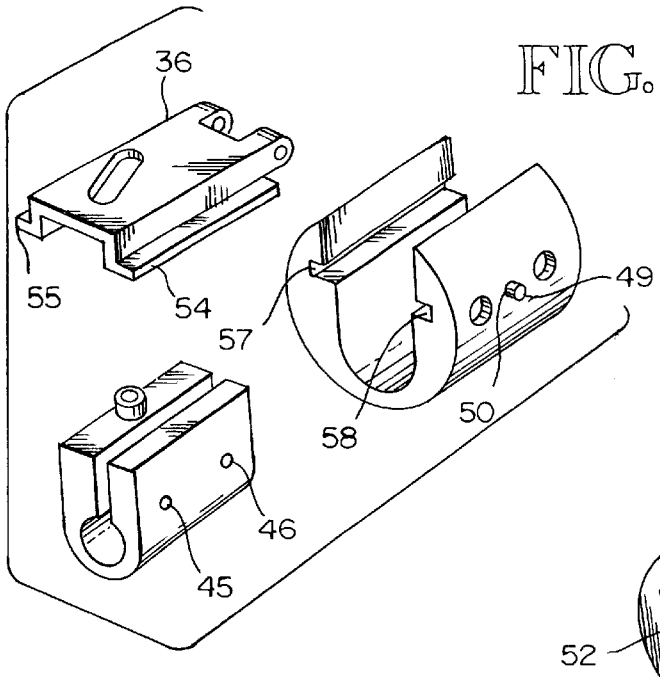
FIG. 6 is an exploded view of the clamp mechanism.

FIG. 6 is an exploded view of the clamp mechanism with parts numbered as in FIG. 5. Flanges 54 and 55 of the cam slide in grooves 56 and 57 in the base.

Figure 7:
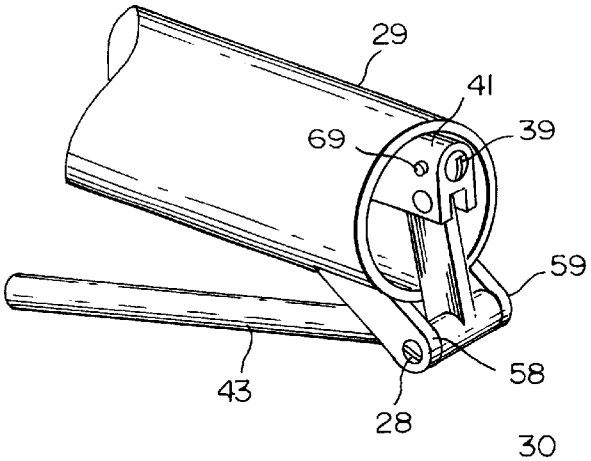
FIG. 7 illustrates the clamp mechanism operation lever.

FIG. 7 illustrates the clamp mechanism operating assembly including the mechanism operation lever 43 and its connection to rod 39 with parts numbered as in FIGS. 1 and 4. Pin 28 is carried in extensions 58 and 59 of fitting 29.

Figure 8:
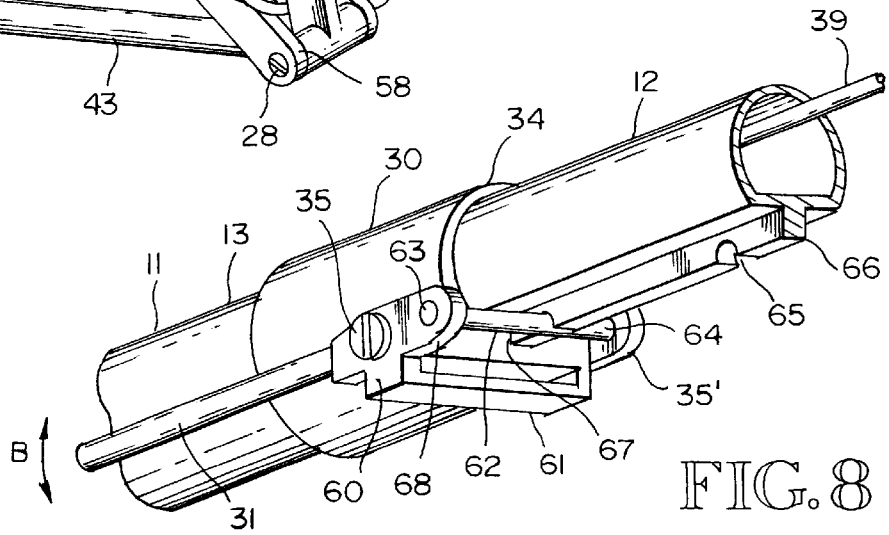
FIG. 8 is a view of the handle length adjustment mechanism taken from below and to one side of the handle.

FIG. 8 illustrates the length lock mechanism 30 in more detail and is a view taken, from below and to one side of the lock mechanism. Lock lever assembly 60 comprises lever 31, rocker 61 and pin 62 carried in holes 63 and 64. The handle length is locked when pin 62 engages one of a series of notches, notch 65 being typical, in rib 66 of tube 12. The rib engages notch 67 in fitting 34 to prevent relative rotation of tubes 11 and 12. Coil torsion spring 68 urges engagement of pin 62 in the notches.

Setscrew 69 (FIG. 7) locks rod 39 and fitting 41 together longitudinally and rotationally. When the setscrew is loosened rod 39 can be rotated to adjust its engagement with fitting 37. This adjustment adjusts the angle of lever 43 with the axis of the handle. The adjustment is set by tightening the setscrew.

It is considered to be understandable from this description that the subject invention meets it objectives. It provides a relatively simple adjustable length handle for flat finishes. The range of angular motion of the box footplate is relatively large. The mechanism is robust and easily adjustable. Also, the handle is relatively lightweight and ergonomically acceptable.

It is also considered to be understood that while certain embodiments of the invention are disclosed, other embodiments and modification so those disclosed are possible within the scope of the invention which is limited only by the attached claims.

I claim:

1. An adjustable length handle for flat finishers, said handle comprising first and second telescopic tubes, each having a free end and an overlapped end, said tubes having a common longitudinal axis, said handle further comprising:

a box footplate, a footplate fitting, a handle length lock mechanism, a clamp mechanism, a clamp mechanism operating assembly, a lock tube and a connecting link, said box footplate being pivotally connected to said footplate fitting on an axis perpendicular to said longitudinal axis, said footplate fitting being attached to said free end of said first tube, said handle length lock mechanism being attached to said overlapped end of said first tube, said clamp mechanism being installed in said overlapped end of said second tube, said clamp mechanism operating assembly being attached to said free end of said second tube, said lock tube being installed in said first and second tubes parallel to said longitudinal axis, extending through said clamp mechanism and being connected to said box footplate by said connecting link, said clamp mechanism operating assembly further comprising a lever and mechanism connecting said lever to said clamp mechanism, whereby, in use of said handle with one of said flat finishers attached to said box footplate, said handle length is adjusted using said handle length lock mechanism, said flat finisher is set against a work surface, setting said box footplate at an angle to said longitudinal axis, said clamp mechanism is operated by said clamp mechanism operating lever, clamping said lock tube and thereby preventing angular movement of said box footplate because said connecting link connects said box footplate to said lock tube, said second tube comprising a longitudinal rib having a series of notches, said handle length lock mechanism comprising a lock lever assembly having a lever, a spring and a pin oriented to engage and disengage any of said notches in said series of notches, whereby relative telescopic motion of said first and second tubes is prevented when said pin engages one of said series of notches and relative telescopic motion of said first and second tubes is allowed when said lever is actuated to move said pin clear of said notches, further whereby the length of said handle is adjustable by disengaging said pin from said notches, moving the tubes telescopically and reengaging said pin in one of said notches, said reengagement being urged by said spring.

2. An adjustable length handle for flat finishers, said handle comprising first and second telescopic tubes, each having a free end and an overlapped end, said tubes having a common longitudinal axis, said handle further comprising:

a box footplate pivotally attached to said free end of said first tube, a handle length lock mechanism attached to said overlapped end of said first tube, a clamp mechanism installed in said overlapped end of said second tube, a clamp mechanism operating assembly attached to said free end of said second tube, means interconnecting said clamp mechanism and said clamp mechanism operating assembly, a longitudinally sliding member installed in said handle and engaging said clamp mechanism and means for converting pivotal motion of said box footplate to longitudinal motion of said longitudinally sliding member, clamping of said longitudinally sliding member prevents pivoted motion of said box footplate on said handle and releasing said longitudinally sliding member allows pivotal motion of said box footplate on said handle, said second tube comprising a longitudinal rib having a series of notches, said handle length lock mechanism comprising a lock lever assembly having a lever, a spring and a pin oriented to engage and disengage any of said notches in said series of notches, whereby relative telescopic motion of said first and second tubes is prevented when said pin engages one of said series of notches and relative telescopic motion of said first and second tubes is allowed when said lever is actuated to move said pin clear of said notches, further whereby the length of said handle is adjustable by disengaging said pin from said notches, moving the tubes telescopically and reengaging said pin in one of said notches, said reengagement being urged by said spring.

* * * * *